US006425795B1

(12) United States Patent
Horsfall et al.

(10) Patent No.: US 6,425,795 B1
(45) Date of Patent: Jul. 30, 2002

(54) BABY DOLL GIFT SET AND METHOD OF MANUFACTURE THEREOF

(76) Inventors: Beth G. Horsfall; Walter S. Horsfall, both of 333 Reseda Pkwy., Palatine, IL (US) 60067

( * ) Notice: Subject to any disclaimer, the term of this patent is extended or adjusted under 35 U.S.C. 154(b) by 7 days.

(21) Appl. No.: 09/781,757

(22) Filed: Feb. 12, 2001

(51) Int. Cl.[7] ..... A63H 3/02

(52) U.S. Cl. ..... 446/73; 446/369; 446/385; 206/225; 206/457

(58) Field of Search ..... 446/71, 72, 73, 446/75, 76, 268, 369, 385, 390, 391, 486; 206/575, 225, 457

(56) References Cited

U.S. PATENT DOCUMENTS

| | | | | |
|---|---|---|---|---|
| 1,026,460 A | | 5/1912 | Rusk | |
| 2,655,762 A | | 10/1953 | Burke | |
| 4,336,665 A | | 6/1982 | Moreau | |
| 4,372,077 A | | 2/1983 | Balbuena | |
| 4,458,372 A | | 7/1984 | Mills | |
| 4,563,159 A | | 1/1986 | Hills et al. | |
| 4,590,633 A | | 5/1986 | Pickens | |
| 4,874,340 A | | 10/1989 | Smallwood | |
| 4,889,512 A | | 12/1989 | Burnett et al. | |
| 4,921,460 A | | 5/1990 | Lin | |
| D316,735 S | | 5/1991 | Burnette et al. | |
| 5,059,149 A | | 10/1991 | Stone | |
| 5,084,930 A | | 2/1992 | Danova | |
| 5,193,675 A | | 3/1993 | Otis | |
| 5,224,894 A | | 7/1993 | Nelson et al. | |
| 5,326,300 A | | 7/1994 | Sonders | |
| 5,374,192 A | * | 12/1994 | Marble et al. | 210/505 |
| 5,421,761 A | | 6/1995 | Pitcher et al. | |
| D385,316 S | | 10/1997 | McCarter | |
| 5,733,170 A | * | 3/1998 | Wotton | 206/457 |
| 5,791,963 A | | 8/1998 | Lieberman | |
| 5,897,420 A | * | 4/1999 | Lawrence et al. | 446/100 |
| 6,092,658 A | | 7/2000 | Pietrafesa | |

* cited by examiner

*Primary Examiner*—Jacob K. Ackun
(74) *Attorney, Agent, or Firm*—Meroni & Meroni, P.C.; Charles F. Meroni, Jr.; Christopher J. Scott

(57) ABSTRACT

The present invention discloses a baby doll gift set comprised of component gift items which, when assembled, are sized and shaped so as to resemble a human infant. A baby doll gift assembly comprises essential component items of this set. Flexible, elongate, cylindrically shaped gift items are transversely inserted through a centralized elastic fabric sleeve to simulate infant appendages. At least one gift item sized and shaped so as to resemble an infant torso is longitudinally sandwiched between the cylindrically shaped gift items inside the elastic fabric sleeve to simulate an infant torso. A spherically shaped gift item is inserted spatially superior to the arm-simulative gift item to simulate an infant head. The resulting baby doll gift assembly may then be further accessorized as desired to complete the baby doll gift set.

27 Claims, 7 Drawing Sheets

BABY DOLL GIFT SET AND METHOD OF MANUFACTURE THEREOF

BACKGROUND OF THE INVENTION

1. Field of the Invention

The present invention relates to a gift package for expectant mothers, and, more particularly, to a gift package for expectant mothers comprising an array of assembled component gift items, which when assembled, are sized and shaped so as to resemble an infant.

2. Description of the Prior Art

The prior art is replete with examples of amusement devices and amusement apparatus having functionality in addition to their respective underlying amusing effect. In this regard, infant and/or animal-simulating dolls and the like have often been developed with an eye toward combining several utilitarian functions into a single embodiment. Dolls having storage capability for blankets and related bedding materials, for example, are known in the prior art, some of which are described hereinafter.

U.S. Pat. No. 4,590,633, which issued to Pickens, discloses a Combination Doll and Blanket. The doll has a conically shaped hollow trunk portion and is comprised of a flexible material that encases a tucked blanket or similar bedding material. The conically shaped trunk portion has a tapered end and a pair of selectively releasable fastening strips opposite the tapered end. The fastening strips serve to secure the blanket within the trunk portion when the tucked blanket configuration is desired and release the blanket from the trunk portion when the open blanket configuration is desired. The blanket is integrally attached to the doll and comprises the stuffing for the trunk portion of the doll when in a tucked configuration. Embellishments such as a hollow head, arms and legs are attached to the trunk portion to constitute a doll with appendages. While the hollow head may provide storage for a portion of the blanket, the embellishments are attached to the trunk portion solely to create a limbed-doll configuration and do not serve an otherwise utilitarian role.

U.S. Pat. No. 4,889,511, which issued to Burnett et al, teaches a combination Doll and Pillow Carrying Case wherein the carrying case has the shape and structure of a rectangular pillow further comprising a pocket. Tucked inside the pocket is an integrally formed doll figure having head, arm and leg members, which may be exposed by opening the pocket and extricating the appendages, thus converting an otherwise pillow shaped item into a doll figure as desired. The appendages of the doll of U.S. Pat. No. 4,889,511 also serve the sole function of creating a limbed doll configuration.

U.S. Pat. No. 5,084,930, which issued to Danova, discloses a Combined Soft Sculpture and Blanket. This patent teaches a soft plush toy embracing the shape of any number of creatures or objects. The toy has both a hollow torso portion and hollow head portion. Integrally attached to the pre-selected creature configuration or the pre-selected object configuration is a blanket or similar article, which, when not being used in an opened blanket configuration, is in a tucked blanket configuration inside the hollow head and hollow torso portions. Appendages are added to complete the configuration of the creature or object as desired but again serve no further function.

The prior art also teaches doll-like structures, which incorporate appendages having storage functionality. For example, U.S. Pat. No. 5,326,300, which issued to Sonders, discloses a Combination Carrying Device and Toy. This disclosure teaches a doll-like structure having at least one inner cavity for storing child-oriented accessories. The legs are described as capable of storing appropriately shaped baby accessories, such as an infant's bottle or similarly shaped article. Essentially, the carrying case is one that is configured to resemble and infant or animal and the like and is assembled from an appropriately flexible fabric to create the amusing effect of the doll-like structure. Doll-like structures, such as U.S. Pat. No. 5,326,300, teach doll-simulative casings having inner cavities for holding child-oriented accessories and/or merchandise, but do not teach doll-like structures comprised of child-oriented accessories and/or merchandise.

Baby gift packages are also known in the prior art. U.S. Pat. No. 5,193,675, which issued to Otis, discloses a Baby Merchandise Display Package. This package is designed to display sets of footwear and other baby merchandise such as a baby rattle. The package is box-like in appearance and includes a light transmissive sleeve as an aid to prevent handling of the merchandise yet allows consumers opportunity to view the arranged merchandise. U.S. Pat. No. 6,092,658, which issued to Pietrafesa, discloses a Simulated Baby Bottle Gift Set. Similarly, this disclosure permits consumers to view an array of baby-oriented merchandise through a light transmissive container comprising the cylindrical body portion of an enlarged simulative baby bottle. The baby-oriented merchandise is arranged inside the light transmissive container so as to create a more alluring effect. The container is capped with a nipple-simulative member, thus completing the baby bottle configuration.

None of the prior art patents described above teaches a gift set wherein an array of child-oriented merchandise is arranged and assembled to create the amusing doll-like structure. Each disclosure herein described teaches a structure having storage functionality capable of storing child-oriented merchandise or subject matter. U.S. Pat. No. 4,921,460, which issued to Lin, discloses Assembled Articles Comprising Stretch Knitted Rings. This disclosure does teach the assemblage of fanciful doll-like structures from a plurality of flexible and stretchable ring-like members. This disclosure does not teach a gift set wherein an array of child-oriented merchandise other than stretchable ring-like members is assembled and presented to the consumer in an amusing doll-like form.

SUMMARY OF THE INVENTION

Accordingly, one objective of the present invention is to provide a gift set package for expectant mothers comprising an array of child-oriented accessories and/or merchandise. Another objective of the present invention is to arrange and assemble an array of child-oriented accessories and/or merchandise in such a manner so as to heighten the amusing effect of receiving a gift set package. Yet another object of the present invention is to arrange and assemble an array of child-oriented accessories and/or merchandise in such a manner so as to resemble an infant-simulating doll, thus further heightening the amusing effect of receiving a gift set package. Still another object of the present invention is to provide an infant-simulating doll, which, when disassembled at the election of the recipient, has individually utilitarian, component parts each being useful in the manner for which it was originally designed.

To attain these objectives, the claimed invention generally comprises the combination of an elastic sleeve having an open end and a closed end opposite the open end. Two spatially inferior limb openings or leg openings are adjacent to the closed end of the elastic sleeve at opposite edges of the elastic sleeve. Intermediate the length between the open end of the elastic sleeve and the closed end of the elastic sleeve are two spatially superior limb openings or arm openings similarly at opposite edges of the elastic sleeve.

A spatially inferior, flexible, elongate, cylindrically shaped gift item, namely, a furled receiving blanket extends transversely through the aforementioned spatially inferior limb openings thus providing the elastic sleeve with spatially inferior limb simulating members or leg-simulating members extending from opposite sides thereof. The leg-simulating members each have a proximal leg region that is adjacent to the respective leg opening in the elastic sleeve and a distal leg end that is preferably bound to prevent the distal leg end from unfurling.

A spatially superior, flexible, elongate, cylindrically shaped gift item, namely, a furled bath towel extends transversely through the aforementioned spatially superior limb openings or arm openings thus providing the elastic sleeve with spatially superior limb simulating members or arm-simulating members extending from opposite sides thereof. The arm-simulating members each have a proximal arm region that is adjacent to the respective arm openings in the elastic sleeve and a distal arm end that is preferably bound to prevent the distal arm end from unfurling.

At least one gift item sized and shaped so as to resemble an infant torso, namely, a furled crib blanket is sandwiched between the furled receiving blanket and the furled bath towel being longitudinally encased within the elastic sleeve, thus providing the elastic sleeve with a torso-simulating portion.

A spherically shaped gift item, namely, a rounded toy-like structure is inserted into the elastic sleeve through the open end coming to rest spatially medial and superior to the furled bath towel, thus creating head-simulating structure. The elastic sleeve is then preferably twisted closed at a point adjacent to the head-simulating structure remote from the open end of the elastic sleeve. The open end is turned down over the head-simulating structure into surrounding relation with the head-simulating structure thus providing neck-simulating structure between the head-simulating structure and the arm-simulating members.

The resultant infant-simulative assembly or basic baby doll gift assembly may be further outfitted with infant accessories and/or merchandise as desired to complete the baby doll gift set.

The gift set may also assume a fanciful creature embodiment and in this instance, the gift set may be sized and shaped to resemble a fanciful creature as desired. The gift set has component parts comprising an elastic fabric sleeve, which simulates a torso. The elastic sleeve further comprises an open end and a closed end opposite the open end. At least one gift item having torso-simulating bulk is longitudinally encased within the elastic sleeve adjacent the closed end. A spherically shaped gift item is inserted into the elastic sleeve spatially medial and superior to the gift item having torso-simulating bulk thus creating a head-simulating structure. The elastic sleeve is closed at a point adjacent the head-simulating structure remote from the open end thus creating an upper section of the elastic sleeve. The upper section is elastically expanded and inverted over an underlying portion of the elastic sleeve. The leading most portion of the open end is then elastically contracted on the spatially inferior portion of the spherically shaped gift item in secured relation thus providing a neck-simulating structure between the spherically shaped gift item and the gift item having torso-simulating bulk to secure the spherically shaped gift item in secured assembly with the elastic sleeve.

The resultant fanciful creature assembly may be further outfitted with pre-selected outer body wear as desired to complete the fanciful creature gift set.

BRIEF DESCRIPTION OF THE DRAWINGS

Other features of our invention will become more evident from a consideration of the following detailed description of our patent drawings, as follows.

DETAILED DESCRIPTION OF THE PREFERRED EMBODIMENT

Preferred Embodiment

Figure 1:
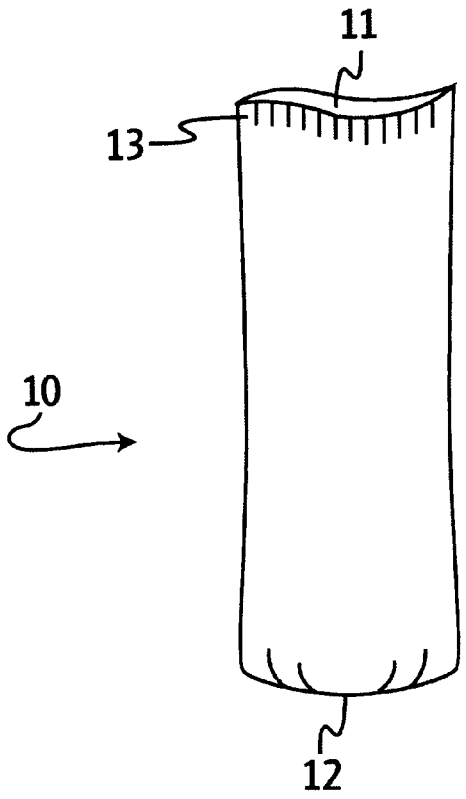
FIG. 1 is a sequential anterior view of the elastic fabric sleeve.
Figure 2:
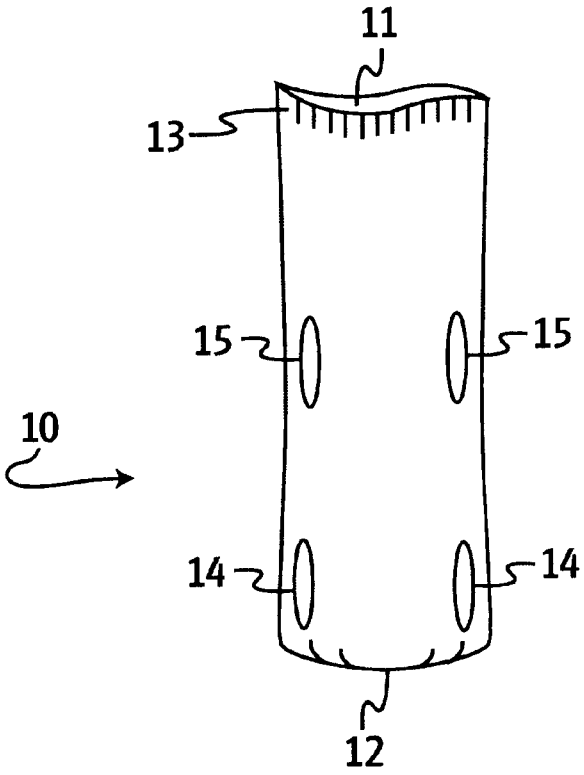
FIG. 2 is a sequential anterior view of the slit elastic fabric sleeve.

Referring now to the drawings, the elastic fabric sleeve 10 is illustrated in FIG. 1 and FIG. 2. Elastic fabric sleeve 10 generally consists of a stretchable, flexible fabric such as spandex or nylon or a combination thereof as exemplified in the Premier Trouser Sock made for the K-Mart Corporation, Troy, Mich., RN# 41000 3844, and has an open end 11 and a closed end 12 as shown in FIG. 1, FIG. 2, FIG. 4, FIG. 6, FIG. 8 and FIG. 10. Open end 11 preferably has elastically reinforced stitching 13 around the perimeter of the aperture in an effort to prevent unraveling of the fabric in the area surrounding open end 11 of elastic fabric sleeve 10 and to further add elasticity to open end 11. Closed end 12 is preferably sewn closed.

Elastic fabric sleeve 10 is then slit at two opposite edges adjacent to closed end 12, thus providing elastic fabric sleeve 10 with two leg openings 14 as shown in FIG. 2. Elastic fabric sleeve 10 is also slit at two opposite edges intermediate the length between open end 11 and closed end 12, thus providing elastic fabric sleeve 10 with two arm openings 15 as also shown in FIG. 2. Leg openings 14 and arm openings 15 may include a means for fabric reinforcement around the perimeter of the respective apertures in an effort to prevent unraveling of the fabric in the areas surrounding leg openings 14 and arm openings 15 of elastic fabric sleeve 10. The coloring of elastic fabric sleeve 10 is ultimately dependent on consumer demand, but it is contemplated that the coloring will most often approximate naturally occurring skin tones.

Figure 3:
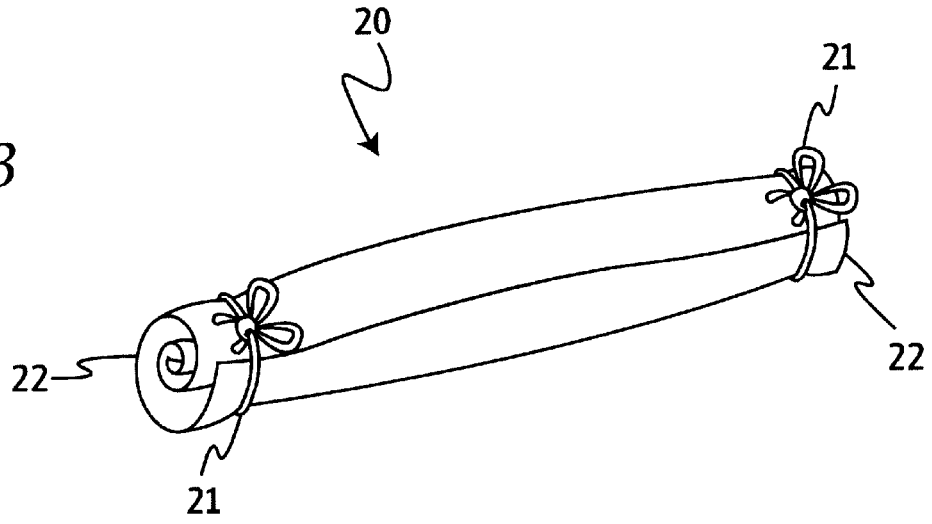
FIG. 3 is a perspective view of the furled receiving blanket.
Figure 4:
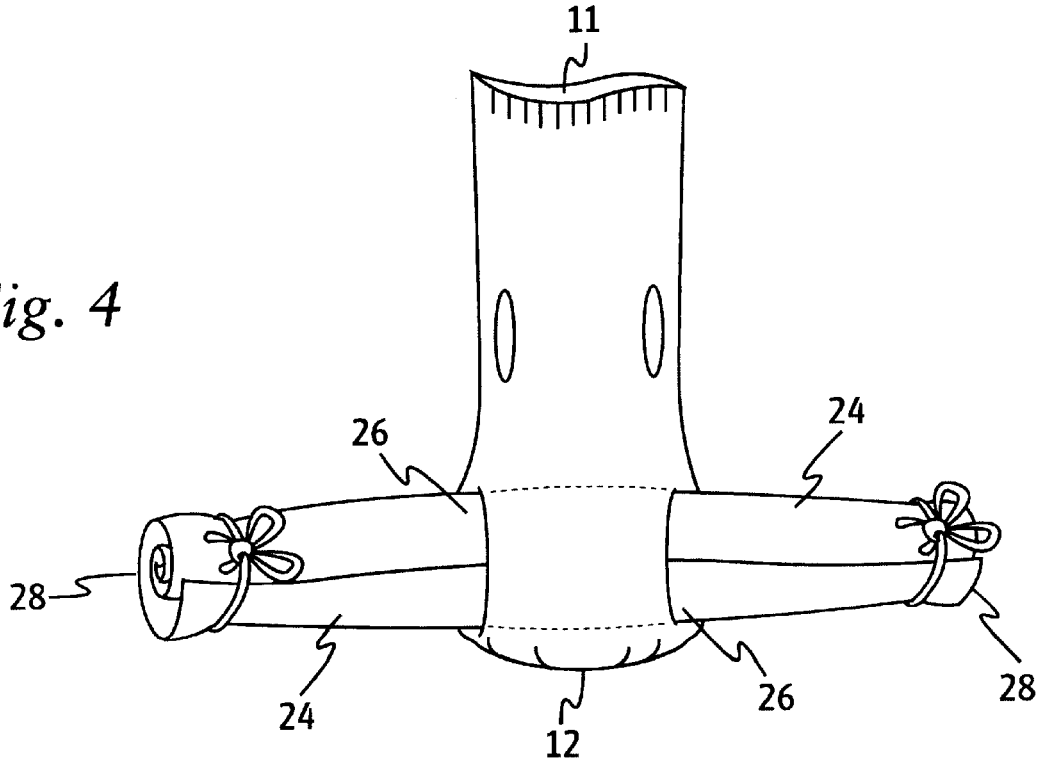
FIG. 4 is a sequential anterior view of the elastic fabric sleeve and furled receiving blanket assemblage.

A thermal receiving blanket is then folded and rolled into a cylindrically shaped furled receiving blanket 20, which is preferably about 21 in length and 2 inches to 2.5 inches in diameter. A furled receiving blanket 20 of the dimensions indicated preferably approximates the dimensions of infant legs measured from the distal end of one leg to the distal end of the other leg and includes the diametral width of the medial torso region therebetween. The ends of furled receiving blanket 20 are then bound preferably by strips of ribbon 21 or similar ornamental binding material as shown in FIG. 3 thus providing furled receiving blanket 20 with bound receiving blanket ends 22. Furled receiving blanket 20 is inserted transversely through leg openings 14 thus providing elastic fabric sleeve 10 with leg-simulating members 24 as shown in FIG. 4. Leg-simulating members 24 thus each have a proximal leg region 26 adjacent its respective leg opening 14 and a distal leg end 28. Distal leg ends 28 correspond to bound receiving blanket ends 22 as comparatively shown in FIG. 3 and FIG. 4.

Figure 5:
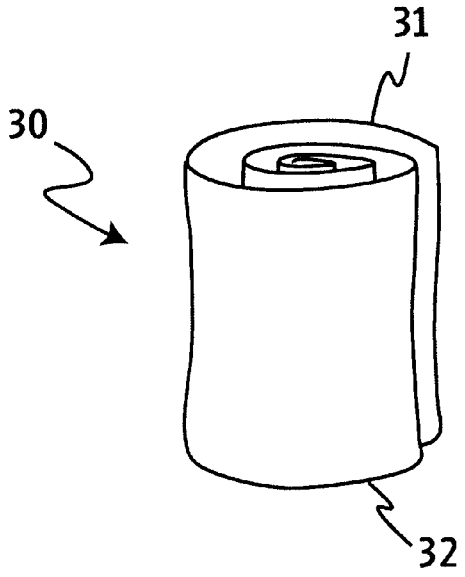
FIG. 5 is a perspective view of the furled crib blanket.
Figure 6:
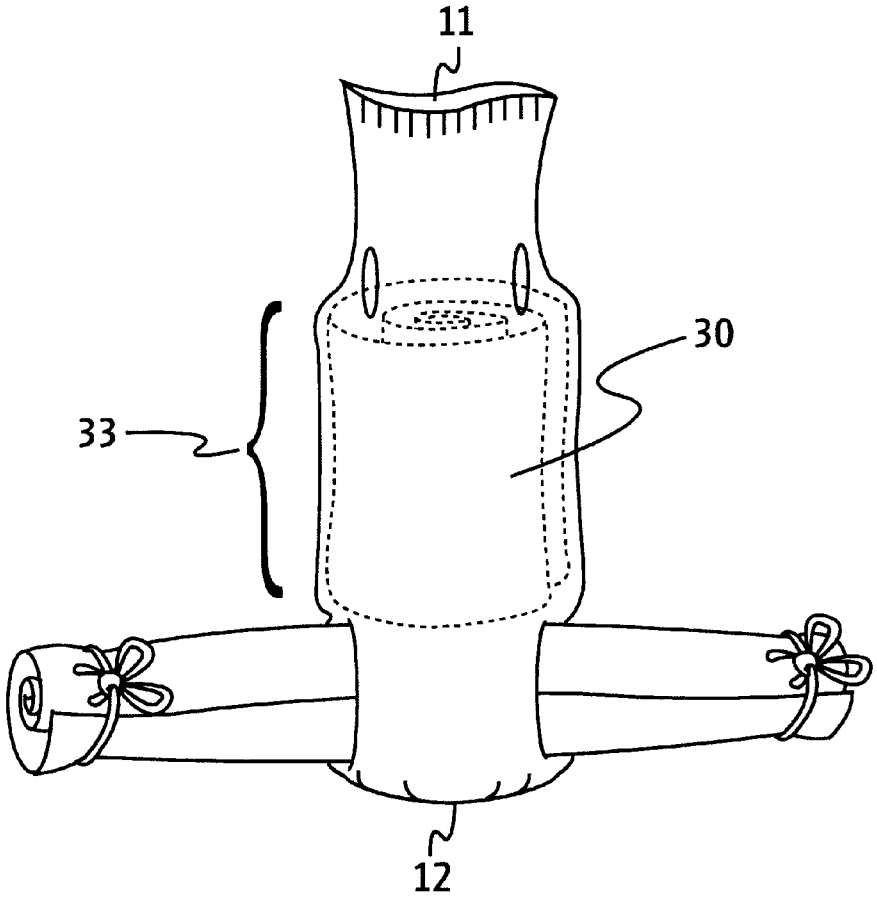
FIG. 6 is a sequential anterior view of the elastic fabric sleeve, furled receiving blanket and hidden furled crib blanket assemblage.

A fleece crib blanket is then folded and rolled into a cylindrically shaped furled crib blanket 30 preferably 8.5 inches in length and 4.5 inches in diameter as shown in FIG. 5. A furled crib blanket 30 of the dimensions indicated preferably approximates the size and shape of an infant torso. Furled crib blanket has a spatially superior end 31 and a spatially inferior end 32 as also shown in FIG. 5. Furled crib blanket 30 is then inserted longitudinally into elastic fabric sleeve 10 such that spatially inferior end 32 rests upon furled receiving blanket 20, thus providing elastic fabric sleeve 10 with a torso-simulating portion 33 as shown in FIG. 6.

A hooded bath towel is then folded and rolled in a cylindrically shaped furled bath towel 40, which is preferably 18 inches in length and 2 inches to 2.5 inches in diameter.

Figure 7:
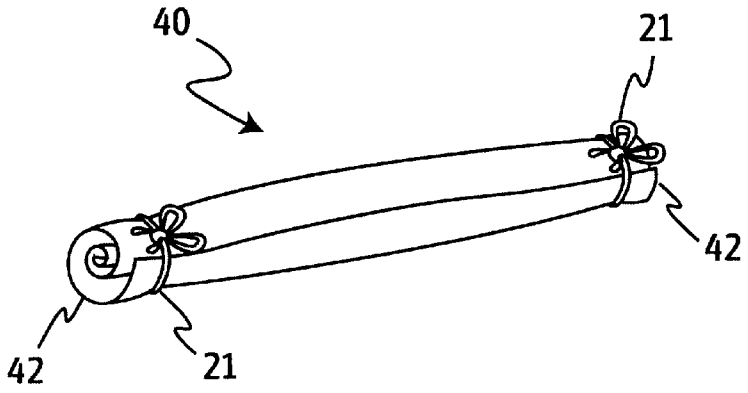
FIG. 7 is a perspective view of the furled bath towel.
Figure 8:
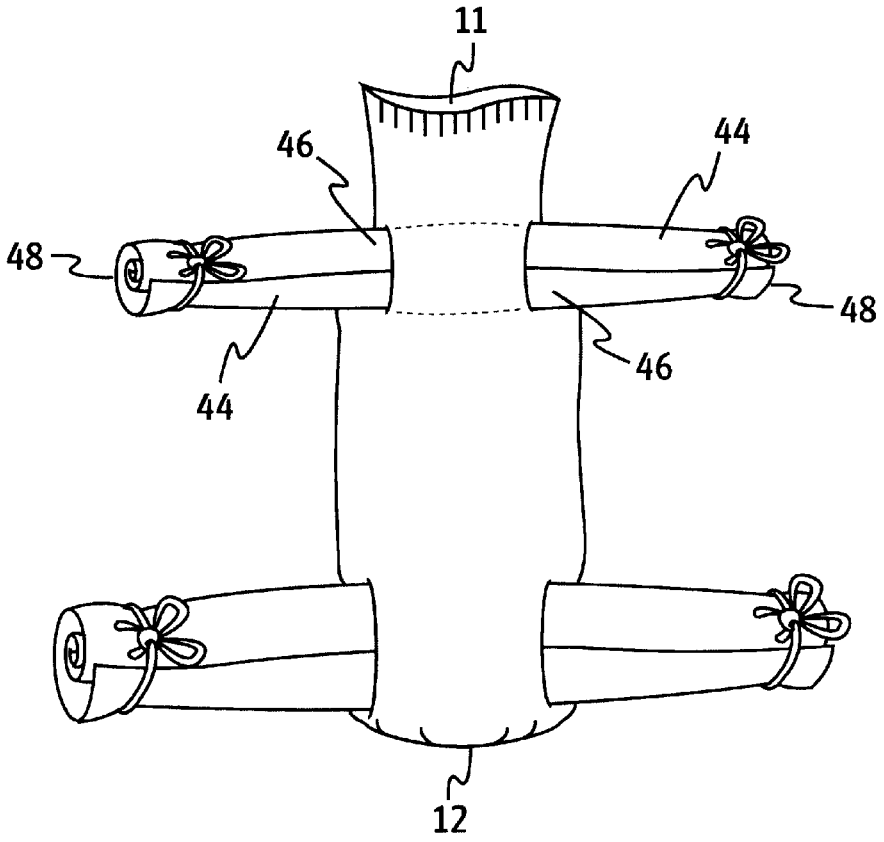
FIG. 8 is a sequential anterior view of the elastic fabric sleeve, furled receiving blanket, furled crib blanket and furled bath towel assemblage.

A furled bath towel 40 of the dimensions indicated preferably approximates the dimensions of infant arms measured from the distal end of one arm to the distal end of the other arm and includes the diametral width of the medial torso region therebetween. The ends of furled bath towel 40 are then bound preferably by strips of ribbon 21 or similar ornamental binding material as shown in FIG. 7, thus providing furled bath towel 40 with bound bath towel ends 42. Furled bath towel 40 is inserted transversely through arm openings 15 thus providing elastic fabric sleeve 10 with arm-simulating members 44 as shown in FIG. 8. Arm-simulating members 44 thus each have a proximal arm region 46 adjacent its respective arm opening 15 and a distal arm end 48. Distal arm ends 48 correspond to bound bath towel ends 42 as comparatively shown in FIG. 7 and FIG. 8.

Figure 9:
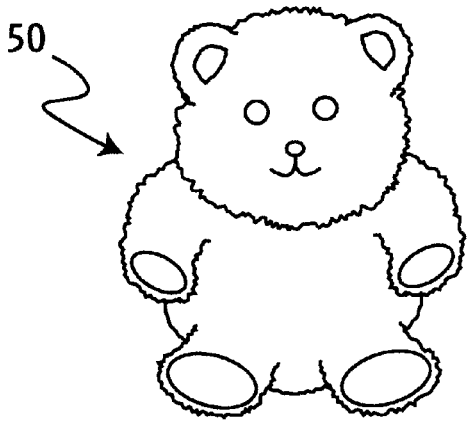
FIG. 9 is an anterior view of an exemplary rounded toy-like structure.
Figure 10:
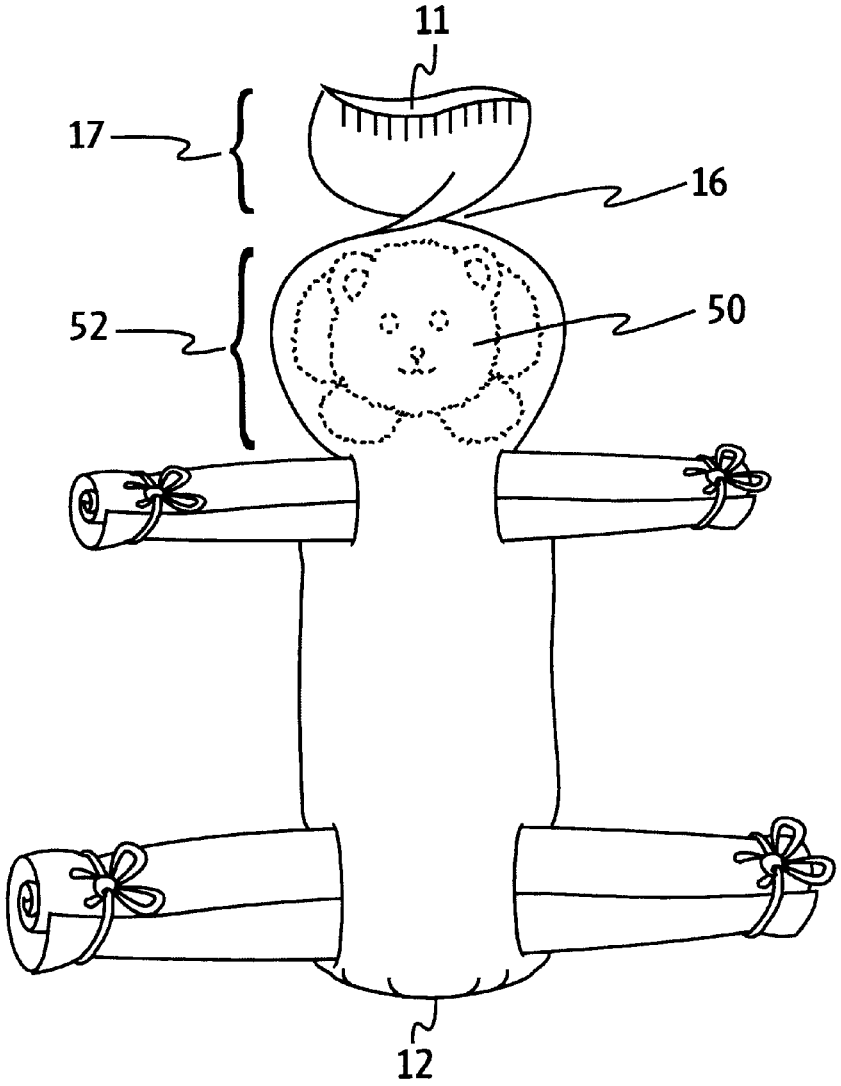
FIG. 10 is a sequential anterior view of the elastic fabric sleeve, furled receiving blanket, furled crib blanket, furled bath towel and rounded toy-like structure assemblage.

An exemplary rounded toy-like structure 50, as illustrated in FIG. 9, is inserted into elastic fabric sleeve 10 so that it rests medial and superior to furled bath towel 40 within elastic fabric sleeve 10, thus creating head-simulating structure 52 as shown in FIG. 10. Rounded toy-like structure 50 may either rest in direct engagement with furled bath towel 40 or be spatially separated from furled bath towel 40. Rounded toy-like structure preferably rests in direct engagement with furled bath towel 40 so as to avoid creating a neck-simulating structure 60 which is overly flaccid. Rounded toy-like structure 50 is substantially spherical in shape or may be manually compressed into a spherical shape and preferably has a cross-sectional diameter of 4.5 inches to 5 inches. A rounded toy-like structure 50 of these dimensions preferably approximates an infant head.

Figure 11:
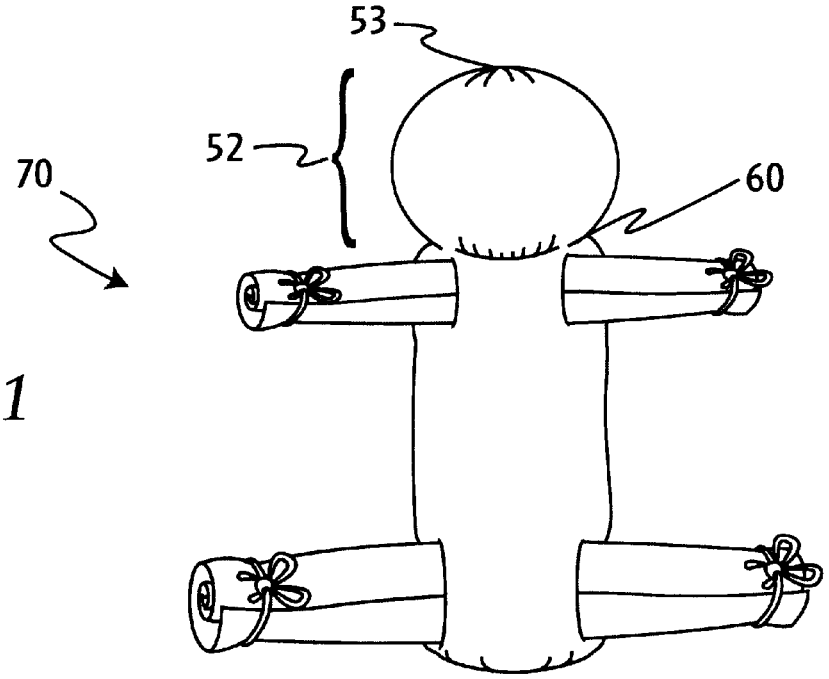
FIG. 11 is a sequential anterior view of the infant-simulating doll assembly.

Elastic fabric sleeve 10 is then twisted closed at a point 16 adjacent to head-simulating structure 52 remote from open end 11 of elastic fabric sleeve 10 thus creating an upper twisted section 17 of elastic fabric sleeve 10 as shown in FIG. 10. Upper twisted section 17 is then elastically expanded and inverted over an underlying portion of elastic fabric sleeve 10. The leading most portion of open end 11 is then elastically contracted on the spatially inferior portion of rounded toy-like structure 50 in secured relation thus providing a neck-simulating structure 60 between rounded toy-like structure 50 and furled bath towel 40 to secure rounded toy-like structure 50 in secured assembly with elastic fabric sleeve 10 as shown in FIG. 11. The inherent elastically induced friction between contacting surfaces of upper twisted section 17 and the underlying portion of elastic fabric sleeve 10 holds the twisted sleeve mass 53 at point 16 from untwisting.

Figure 14:
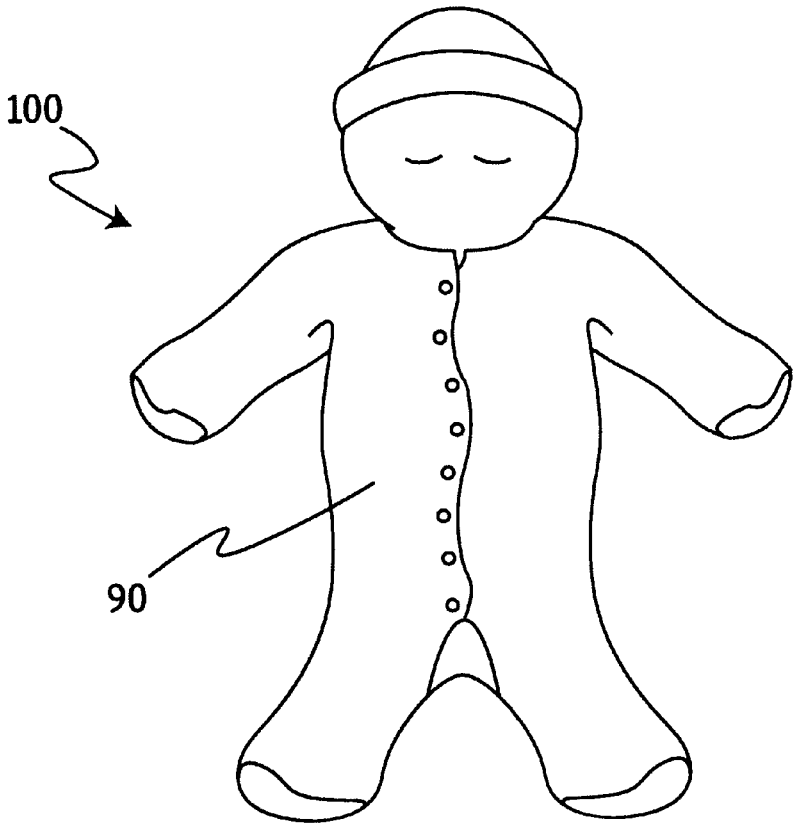
FIG. 14 is a sequential anterior view of the complete baby doll gift set.

The resultant infant-simulating assembly 70 as illustrated in FIG. 11 may be further outfitted with infant accessories and/or merchandise as desired. Consumers desirous of added accessories and/or merchandise may purchase a baby doll gift set 100, as shown in FIG. 14, which may include any number of accessories and/or merchandise items. All baby doll gift sets will include infant-simulating assembly 70 as heretofore described.

Figure 12:
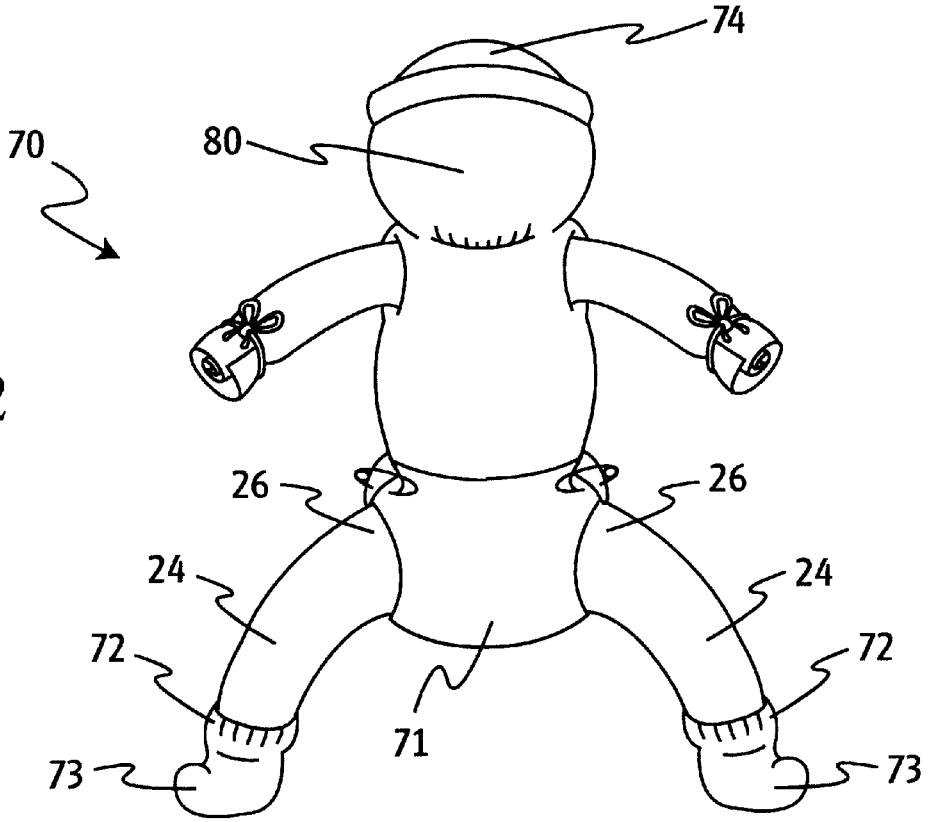
FIG. 12 is a sequential anterior view of the infant-simulating doll assembly outfitted with exemplary accessories.

To illustrate one contemplated method of accessorizing infant-simulating assembly 70 to create a more amusing effect and to complete baby doll gift set 100, FIG. 12 illustrates infant-simulating assembly 70 outfitted with a diaper 71, which is secured around closed end 12 and leg-simulating members 24 such that proximal leg regions 26 are viewably exposed. Diaper 71 thus conceals from sight the otherwise incorrect anatomical features of infant-simulating assembly 70 further contributing to the overall amusing effect.

Similarly, footwear 72 may be placed on distal leg ends 28, thus creating foot-simulating members 73 and obstructing from sight the otherwise incorrect anatomical features of infant-simulating assembly 70 further contributing to the overall amusing effect. It is contemplated that hand wear may be similarly placed on distal arm ends 48 to achieve a similar result.

Additionally, a cap 74 may be placed on head-simulating structure 52, thus obstructing from sight unsightly twisted sleeve mass 53 shown in FIG. 11, outlining facial region 80 as shown in FIG. 12 and further contributing to the overall amusing effect.

Figure 13:
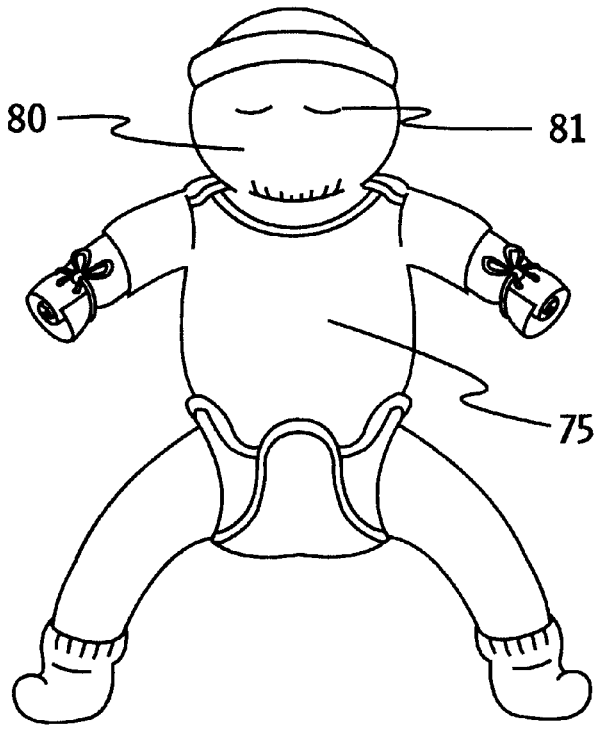
FIG. 13 is a sequential anterior view of the infant-simulating doll assembly outfitted with exemplary accessories.

To further illustrate how infant-simulating assembly 70 may be accessorized to create a more amusing effect, FIG. 13 is provided showing a sequential anterior view of infant-simulating assembly 70. As shown in FIG. 13, infant-simulating assembly 70 may then be outfitted with a one-piece undergarment 75 which envelopes diaper 71 and torso-simulating portion 32, thus concealing from sight diaper 71 and torso-simulating portion 32 as demonstratively shown in FIG. 13. Facial region 80 may be further illustrated with exemplary facial features 81 as shown in FIG. 13 thus contributing to the overall amusing effect.

Baby doll gift set 100 as shown in FIG. 14 is wearing an infant garment 90 thereby concealing from sight one-piece undergarment 75, arm-simulating members 44, leg-simulating members 24 and footwear 72. Infant garment 90 thus completes baby doll gift set 100, wraps infant-simulating assembly 70 having been outfitted with desired accessories, and further contributes to the overall amusing effect. Baby doll gift set 100 is thus comprised of essential component gift items and optional component gift items. The essential component gift items are elastic fabric sleeve 10, furled receiving blanket 20, furled crib blanket 30, furled bath towel 40 and rounded toy-like structure 50 or similarly sized and shaped gift items. These essential component gift items are assembled as described above to create infant-simulating assembly 70, which may then be outfitted and accessorized as desired. The preferred accessories and manner of outfitting infant-simulating assembly 70 are also described above.

The reader will see that the preferred baby doll gift set herein described provides a gift set package for expectant mothers comprising an array of child-oriented accessories and/or merchandise. The reader will further see that an array of child-oriented accessories and/or merchandise is arranged and assembled in such a manner so as to heighten the amusing effect of receiving a gift set package. The reader will further see that an array of child-oriented accessories and merchandise is arranged and assembled in such a manner so as to resemble an infant-simulating doll, thus further heightening the overall amusing effect of receiving a gift set package. The reader will also see that the baby doll gift set, when disassembled at the election of the recipient, has individually utilitarian, component parts each being useful in the manner for which it was originally designed.

While our above description contains many specificities, these should not be construed as limitations on the scope of the invention, but rather as an exemplification of the invention. For example, the elastic fabric sleeve need not be made of spandex or nylon. So long as the sleeve has retentive elasticity such that the furled receiving blanket, furled crib blanket, furled bath towel and rounded toy-like structure may be encased therein and held in such a manner so as to avoid shifting, the sleeve successfully fulfills its retentive purpose. An elastic fabric sleeve made of spandex or nylon preferably fulfills this retentive function.

The furled receiving blanket need not be a thermal receiving blanket. The furled receiving blanket member or similarly shaped gift item serves a leg-simulating function once it is inserted through the elastic fabric sleeve. So long as the gift item is of an elongated cylindrical shape capable of forming leg-simulating members once inserted through the elastic fabric sleeve, the furled receiving blanket or similarly shaped gift item fulfills its leg-simulating function. Further the furled receiving blanket need not be 21 inches in length and 2 inches to 2.5 inches in diameter. A furled receiving blanket of the dimensions described is preferable as these dimensions more closely approximate the dimensions of infant legs when inserted through the elastic fabric sleeve, thus further contributing to the overall amusing effect.

The torso-simulating portion need not result from sandwiching a furled crib blanket between the furled receiving blanket and the furled bath towel. The furled crib blanket or similarly shaped gift item serves a torso-simulating function once it is inserted into the elastic fabric sleeve. It is contemplated that any bulky gift item or gift items capable of being inserted in the elastic fabric sleeve so as to cause the elastic fabric sleeve to thicken in the torso region to resemble the torso of an infant, is sufficient. A furled crib blanket preferably serves this purpose in that a furled crib blanket of the dimensions described more closely approximates the size of an infant torso and is tactilely soft thus contributing to the overall amusing effect. Further, the furled crib blanket need not be 8.5 inches in length and 4.5 inches in diameter. A furled crib blanket 8.5 inches in length and 4.5 inches in diameter is preferable as these dimensions more closely approximate the dimensions of an infant torso when inserted into the elastic fabric sleeve, thus further contributing to the overall amusing effect.

The furled bath towel need not be a hooded bath towel. The furled bath towel serves an arm-simulating function once it is inserted through the elastic fabric sleeve. So long as the gift item is of an elongated cylindrical shape capable of forming arm-simulating members once inserted through the elastic fabric sleeve, the furled bath towel or similarly shaped gift item fulfills its arm-simulating function. Further, the furled bath towel need not be 18 inches in length and 2 inches to 2.5 inches in diameter. A furled bath towel of the dimensions described is preferable as these dimensions more closely approximate the dimensions of infant arms when inserted through the elastic fabric sleeve, thus further contributing to the overall amusing effect.

The rounded toy-like structure serves a head-simulating function. So long as the rounded toy-like structure is spherically shaped or could be compressed into a spherical shape and capable of simulating a head when inserted into the elastic fabric sleeve, it fulfills its head-simulating function. Further, the rounded toy-like structure need not be 4.5 inches to 5 inches in cross-sectional diameter. A rounded toy-like structure 4.5 inches to 5 inches in cross-sectional diameter is preferable as these dimensions more closely approximate the dimensions of an infant head when inserted into the elastic fabric sleeve, thus further contributing to the overall amusing effect.

Accordingly, the scope of the invention should not be determined by the embodiments illustrated but by the appended claims and their legal equivalents.

We claim:

1. A method of manufacture of an infant-simulating doll, the steps of:

providing an elastic fabric sleeve, the elastic fabric sleeve further comprising:
- an open end;
- a closed end opposite the open end;
- leg openings at opposite edges of the elastic fabric sleeve adjacent the closed end;
- arm openings at opposite edges of the elastic fabric sleeve intermediate the length between the open end and the closed end;

providing a receiving blanket;

rolling the receiving blanket into a furled receiving blanket;

inserting the furled receiving blanket transversely through the leg openings thus providing the elastic fabric sleeve with leg-simulating members extending from opposite sides thereof, the leg-simulating members each further comprising:
- a proximal leg region adjacent each the leg opening;
- a distal leg end;

providing a crib blanket rolling the crib blanket into a furled crib blanket, the furled crib blanket further comprising:
- a spatially superior top end;
- a spatially inferior bottom end;

inserting the furled crib blanket longitudinally through the open end until the bottom end rests against the furled receiving blanket thus providing the elastic fabric sleeve with a torso-simulating portion;

providing a bath towel;

rolling the bath towel into a furled bath towel;

inserting the furled bath towel transversely through the arm openings thus providing the elastic fabric sleeve with arm-simulating members extending from opposite sides thereof, the arm-simulating members each further comprising:

a proximal arm region adjacent each the arm opening;

a distal arm end;

providing a rounded toy;

inserting the rounded toy into the open end and resting the rounded toy on the furled bath towel thus providing the elastic fabric sleeve with a head-simulating member;

twisting the elastic fabric sleeve extending above the rounded toy to close the elastic fabric sleeve at the area twisted; and turning the open end over the head-simulating portion into surrounding relation with the head-simulating member thus providing the elastic fabric sleeve with a neck-simulating region between the head-simulating member and the arm-simulating members.

2. The method of manufacture of the infant-simulating doll of claim 1 wherein the method of manufacture further includes the steps of:

binding each the distal leg end to prevent the furled receiving blanket from unfurling; and binding each the distal arm end to prevent the furled bath towel from unfurling.

3. The method of manufacture of the infant-simulating doll of claim 2 wherein the method of manufacture further includes the step of applying a diaper to the closed end permitting the leg-simulating members to extend from opposite sides of the diaper.

4. The method of manufacture of the infant-simulating doll of claim 3 wherein the method of manufacture further includes the step of applying footwear to each the distal leg end thus creating foot-simulating members.

5. The method of manufacture of the infant-simulating doll of claim 4 wherein the method of manufacture further includes the step of applying headwear to the head-simulating member thus outlining a facial region.

6. The method of manufacture of the infant-simulating doll of claim 5 wherein the method of manufacture further includes the step of enveloping the elastic fabric sleeve with an undergarment permitting the leg-simulating members and the arm-simulating members to extend outwardly from the undergarment.

7. The method of manufacture of the infant-simulating doll of claim 6 wherein the method of manufacture further includes the step of illustrating the facial region with face-simulating markings.

8. The method of manufacture for the infant-simulating doll of claim 7 wherein the method for manufacture further includes the step of outfitting the infant-simulating doll with pre-selected clothing accessories.

9. A method of manufacture for a baby doll gift set comprising the steps of:

providing an elastic sleeve, the elastic sleeve further comprising:

an open end;

a closed end opposite the open end;

leg openings at opposite edges of the elastic sleeve adjacent the closed end;

arm openings at opposite edges of the elastic sleeve intermediate the length between the open end and the closed end;

providing two flexible elongate cylindrically shaped gift items, the flexible elongate cylindrically shaped gift items further comprising:

a spatially inferior gift item;

a spatially superior gift item;

inserting the spatially inferior gift item transversely through the leg openings thus providing the elastic sleeve with leg-simulating members extending from opposite sides thereof, the leg-simulating members each further comprising:

a proximal leg region adjacent each the leg opening;

a distal leg end;

providing at least one gift item, the gift item having torso-simulating bulk, the gift item further comprising:

a spatially inferior end;

a spatially superior end;

inserting the gift item longitudinally through the open end until the spatially inferior end rests against the spatially inferior gift item, thus providing the elastic sleeve with a torso-simulating portion;

inserting the spatially superior gift item transversely through the arm openings thus providing the elastic sleeve with arm-simulating members extending from opposite sides thereof, the arm simulating members each further comprising:

a proximal arm region adjacent each the arm opening;

a distal arm end;

providing a rounded gift item;

inserting the rounded gift item into the open end until the rounded gift item rests spatially superior to the spatially superior gift item thus providing the elastic sleeve with a head-simulating member;

closing the elastic sleeve at a point remote from the open end adjacent to the head-simulating member; and turning the open end over the head-simulating member into surrounding relation with the head-simulating member thus providing the elastic sleeve with a neck-simulating region between the head-simulating member and the arm-simulating members.

10. The method of manufacture for the baby doll gift set of claim 9 wherein the method of manufacture further includes the step of applying footwear to each the distal leg end thus creating foot-simulating members.

11. The method of manufacture for the baby doll gift set of claim 10 wherein the method of manufacture further includes the step of applying headwear to the head-simulating member thus outlining a facial region.

12. The method of manufacture for the baby doll gift set of claim 11 wherein the method of manufacture further includes the step of outfitting the baby doll gift set with pre-selected accessories.

13. The method of manufacture for the baby doll gift set of claim 11 wherein the method of manufacture further includes the step of illustrating the facial region with facial feature-simulating markings.

14. A method of manufacture for an infant-simulating doll, the steps of:

forming an elastic fabric sleeve having a tubular configuration and being open at opposite ends;

closing one end of the elastic fabric sleeve thereby creating an elastic fabric sleeve further comprising:

an open end;

a closed end opposite the open end;

cutting longitudinally spaced sets of openings in the elastic fabric sleeve with a first set of openings being adjacent to the closed end and a second set of openings being intermediate the length between the open end and the closed end with the openings in each set of openings being opposed to one another and positioned approximately 180 degrees apart;

rolling a first blanket into a first blanket roll;

securing opposite ends of the first blanket roll to hold the first blanket roll in a rolled condition;

inserting the secured first blanket roll through the first set of openings leaving portions of the first blanket roll extending outwardly on opposite sides of the elastic fabric sleeve;

rolling a second blanket into a second blanket roll;

securing opposite ends of the second blanket roll to hold the second blanket roll in a rolled condition;

inserting the secured second blanket roll through the second set of openings leaving portions of the second blanket roll extending outwardly on opposite sides of the elastic fabric sleeve;

inserting a rounded toy through the open end of the elastic fabric sleeve resting it upon an area of the second blanket roll inside the elastic fabric sleeve to maintain the rounded toy in a supportive position;

twisting an upper section of the elastic fabric sleeve near the open end which extends beyond the rounded toy to close the open end of the elastic fabric sleeve, inverting the elastic fabric of the twisted upper section of the elastic fabric sleeve causing the inverted elastic fabric to encapsulate the rounded toy with the outer end of the inverted elastic fabric sleeve reducing the diameter of the elastic fabric sleeve between the rounded toy and the area of the second blanket roll to form a neck area and to secure the rounded toy in secured assembly with the elastic fabric sleeve.

15. The method of manufacture of an infant-simulating doll of claim 14, wherein the method of manufacture further includes the steps of:

positioning the first blanket roll in the elastic fabric sleeve such that the portions extending outwardly from the elastic fabric sleeve are equidistant in length relative to one another; and positioning the second blanket roll in the elastic fabric sleeve such that the portions extending outwardly from the elastic fabric sleeve are equidistant in length relative to one another.

16. The method of manufacture of an infant-simulating doll of claim 15, wherein the method of manufacture includes the further step of encasing at least one gift item sized and shaped so as to resemble an infant torso within the elastic fabric sleeve between the first blanket roll and the second blanket roll thereby creating a torso-simulating portion.

17. A gift set for a baby shower, the gift set sized and shaped to resemble an infant having component parts comprising the combination of:

an elastic fabric sleeve, the elastic fabric sleeve further comprising:

an open end;

a closed end opposite the open end;

leg openings at opposite edges of said elastic fabric sleeve adjacent the closed end;

arm openings at opposite edges of said elastic sleeve intermediate the length between said open end and said closed end;

a furled blanket extending transversely through said leg openings thus providing said elastic fabric sleeve with leg-simulating members extending from opposite sides thereof, the leg-simulating members each further comprising:

a proximal leg region adjacent each said leg opening;

a distal leg end;

a furled towel extending transversely through said arm openings thus providing said elastic fabric sleeve with arm-simulating members extending from opposite sides thereof, the arm simulating members each further comprising:

a proximal arm region adjacent each said arm opening;

a distal arm end;

at least one gift item, the gift item having torso-simulating bulk, said gift item longitudinally encased within said elastic fabric sleeve intermediate said furled blanket and said furled towel thus creating a torso-simulating portion; and a rounded toy-like structure resting spatially medial and superior to said furled towel inside said elastic fabric sleeve thus creating head-simulating structure, said elastic fabric sleeve being twisted closed at a point adjacent the head-simulating structure remote from said open end thus creating an upper twisted section of said elastic fabric sleeve, the upper twisted section being elastically expanded and inverted over an underlying portion of said elastic fabric sleeve, the leading most portion of said open end being elastically contracted on the spatially inferior portion of said rounded toy-like structure in secured relation thus providing a neck-simulating structure between the rounded toy-like structure and the furled towel to secure the rounded toy-like structure in secured assembly with the elastic fabric sleeve.

18. The gift set of claim 17 wherein said distal leg ends and said distal arm ends are bound to prevent said distal leg ends and said distal arm ends from unfurling.

19. The gift set of claim 18 wherein said gift set further includes pre-selected infant garments outfitting said gift set to resemble a clothed infant.

20. The gift set of claim 19 wherein said head-simulating structure is illustrated with facial feature simulating markings.

21. A gift set, the gift set sized and shaped to resemble a limbed vertebrate having component parts comprising the combination of:

an elastic sleeve, the elastic sleeve further comprising:

an open end;

a closed end opposite the open end;

spatially inferior limb openings at opposite edges of said elastic sleeve adjacent the closed end;

spatially superior limb openings at opposite edges of said elastic sleeve intermediate the length between said open end and said closed end;

a spatially inferior flexible elongate cylindrically shaped gift item extending transversely through said spatially inferior limb openings thus providing said elastic sleeve with spatially inferior limb-simulating members extending from opposite sides thereof, the spatially inferior limb-simulating members each further comprising:

a proximal inferior limb region adjacent each said spatially inferior limb opening;

a distal inferior limb end;

a spatially superior flexible elongate cylindrically shaped gift item extending transversely through said spatially superior limb openings thus providing said elastic sleeve with spatially superior limb-simulating members extending from opposite sides thereof, the spatially superior limb-simulating members each further comprising:

a proximal superior limb region adjacent each said spatially superior limb opening;

a distal superior limb end;

at least one gift item, the gift item having torso-simulating bulk, said gift item longitudinally encased within said elastic sleeve intermediate said spatially inferior flexible elongate cylindrically shaped gift item and said spatially superior flexible elongate cylindrically shaped gift item thus creating torso-simulative structure; and a spherically shaped gift item resting spatially medial and superior to the spatially superior flexible elongate cylindrically shaped gift item thus creating head-simulating structure, said elastic sleeve being closed at a point adjacent the head-simulating structure remote from the open end thus creating an upper section of said elastic sleeve, the upper section being elastically expanded and inverted over an underlying portion of said elastic sleeve, the leading most portion of said open end being elastically contracted on the spatially inferior portion of said spherically shaped gift item in secured relation thus providing a neck-simulating structure between the spherically shaped gift item and the spatially superior flexible elongate cylindrically shaped gift item to secure the spherically shaped gift item in secured assembly with the elastic sleeve.

22. The gift set of claim 21 wherein said gift set further includes pre-selected outer body wear outfitting said gift set to resemble an outfitted limbed vertebrate.

23. The gift set of claim 22 wherein said head-simulating structure is illustrated with facial feature-simulating markings.

24. A gift set for a baby shower, the gift set sized and shaped to resemble an infant having component parts comprising the combination of:

an elastic fabric sleeve, the elastic fabric sleeve simulating an infant torso, said elastic fabric sleeve further comprising:

an open end;

openings at opposite edges of said elastic fabric sleeve adjacent but spaced from the open end;

a flexible elongated structure extending transversely through said openings and through said elastic fabric sleeve with said flexible elongated structure providing arm-simulating members extending form opposite sides of said elastic fabric sleeve; and a rounded toy-like structure resting on said flexible elongated structure inside said elastic fabric sleeve beneath said open end, said elastic fabric sleeve being twisted closed at a point atop the rounded toy-like structure remote from said open end, said open end elastically expanded and inverted over an underlying portion of said elastic fabric sleeve, the leading most portion of said open end being elastically contracted on the spatially inferior portion of said rounded toy-like structure in secured relation thus providing a neck-simulating structure between said rounded toy-like structure and said flexible elongated structure.

25. A gift set for a baby shower of claim 24, wherein the gift set further includes at least one gift item sized and shaped to resemble an infant torso, the gift item longitudinally encased within said elastic fabric sleeve intermediate said first blanket roll and said second blanket roll thereby creating a torso-simulating portion.

26. A gift set, the gift set sized and shaped to resemble an fanciful creature having component parts comprising the combination of:

an elastic sleeve, the elastic sleeve simulating a torso, said elastic sleeve further comprising:

an open end;

a closed end opposite the open end;

at least one gift item, the gift item having torso-simulating bulk, said gift item longitudinally encased within said elastic sleeve adjacent the closed end; and a spherically shaped gift item resting spatially medial and superior to the gift item within said elastic sleeve thus creating head-simulating structure, said elastic sleeve being closed at a point adjacent the head-simulating structure remote from the open end thus creating an upper section of said elastic sleeve, the upper section being elastically expanded and inverted over an underlying portion of said elastic sleeve, the leading most portion of said open end being elastically contracted on the spatially inferior portion of said spherically shaped gift item in secured relation thus providing a neck-simulating structure between said spherically shaped gift item and the gift item to secure the spherically shaped gift item in secured assembly with the elastic sleeve.

27. The gift set of claim 26 wherein the gift set further includes pre-selected outer body wear outfitting said gift set to resemble an outfitted fanciful creature.

* * * * *